US006835115B2

(12) United States Patent
Syrjänen

(10) Patent No.: US 6,835,115 B2
(45) Date of Patent: Dec. 28, 2004

(54) GRINDING METHOD

(75) Inventor: Teppo Syrjänen, Kangaslampi (FI)

(73) Assignee: Rolltest Oy, Kangaslampi (FI)

( * ) Notice: Subject to any disclaimer, the term of this patent is extended or adjusted under 35 U.S.C. 154(b) by 0 days.

(21) Appl. No.: 10/621,716

(22) Filed: Jul. 18, 2003

(65) Prior Publication Data

US 2004/0029487 A1 Feb. 12, 2004

Related U.S. Application Data

(63) Continuation-in-part of application No. 10/025,504, filed on Dec. 26, 2001, now abandoned.

(30) Foreign Application Priority Data

Dec. 22, 2000 (FI) ..... 20002837

(51) Int. Cl.[7] ..... B24B 1/00

(52) U.S. Cl. ..... 451/5; 451/9; 451/10; 451/11; 451/49

(58) Field of Search ..... 451/5, 6, 8, 9, 451/10, 11, 49

(56) References Cited

U.S. PATENT DOCUMENTS 3,886,693 A * 6/1975 Tajnafoi et al. ..... 451/251
5,371,975 A 12/1994 Lundmark
5,533,931 A 7/1996 Imai et al.
5,562,523 A 10/1996 Asano et al.
5,562,526 A 10/1996 Yoneda et al.
5,595,525 A 1/1997 Hayashi et al.
5,620,358 A 4/1997 Furukawa et al.
5,679,053 A 10/1997 Sakakura et al.
5,718,519 A * 2/1998 Ookouchi et al. ..... 384/569
5,945,595 A 8/1999 Mori et al.
5,957,756 A 9/1999 Figge et al.
5,975,995 A 11/1999 Hykes et al.

* cited by examiner

*Primary Examiner*—Eileen P. Morgan
(74) *Attorney, Agent, or Firm*—Young & Thompson

(57) ABSTRACT

A grinding method for single-disc cylindrical grinding of elongated objects, such as cylindrical paper machine rollers, in which method the object to be grounded is rotated about its axis and a grinding stone is rotated and its position on the surface of the object being ground is adjusted so that the grinding point of the grinding stone is held substantially at a constant distance from the center axis of the object being ground regardless of the deflection of the object. In the method, the position of the grinding stone is adjusted using an oscillating positioning controller synchronized with the rotation of the roller and receiving feedback from a measured quantity that bears a linear correlation to the change of position of the surface being ground.

6 Claims, No Drawings

GRINDING METHOD

This application is a Continuation In Part of Ser. No. 10/025,504 filed Dec. 26, 2001, now abandoned.

BACKGROUND OF THE INVENTION

The present invention relates to a grinding method, in particular, the invention relates to the grinding of substantially cylindrical paper machine rollers, but it can also be used in grinding the surfaces of other elongated cylindrical or conical objects. In the following, however, the invention will be mainly described by referring to cylindrical paper machine rollers.

Heavy and relatively long paper machine rollers are generally stored by suspending them by their hubs, with the result that the rollers are bent by the action of their own weight, i.e. curved downward relative to the straight line between their hubs. In practice, the roller hardly ever bends in one plane only; instead, due to a variation of stiffness and different positions during transport and storage, the ultimate deflection is a three-dimensional curve. When the roller is again mounted as a rotating component, it begins to straighten out slowly, approaching the straight line between its hubs. The speed and degree of straightening is proportional to the length of time the roller has been kept in a non-rotating condition in storage. Typically, this time varies from a few hours to several days.

When a grinding operation on a curved roller taken from storage is started, the deflection causes unnecessary working time expenses because the roller has to be rotated in the grinding machine for several hours before actual grinding can be started. By the time grinding is started, the roller is seldom completely straight, which is why the grinding pressure and also the amount of material removed vary depending on the degree of eccentricity of the roller. Thus, the roller undergoes unnecessary machining and material is removed from where it should not in order to achieve a desired rotational and length profile of the roller.

If the roller has originally been circular in section but undergone deflection during storage, it may have been ground to a non-circular cross-sectional form while expecting it to be straightened. If the roller is to be given a circular cross-sectional form, then it has to be ground long enough to allow the rotation to produce sufficient straightening or a sufficiently stable condition, and after this the grinding has to be continued until the deformation produced by incorrect grinding has been abraded.

After the roller has been ground, it is often put back in store, where the bending process starts again. When finally mounted in the paper machine, the roller may be as curved as before the grinding.

SUMMARY OF THE INVENTION

The object of the invention is to eliminate the above-mentioned drawbacks. A specific object of the invention is to disclose a new type of grinding method whereby the currently most widely used single-disc machines can achieve the same grinding precision that has previously only been attainable by using dual-disc machines with floating stone suspension.

In the text of the present application, the roller form aimed at is described by the general term 'circular' to refer to the most advantageous rotational profile of a roller. The desired grinding profile of the roller may differ from a circular orbit if grinding is undertaken to compensate for errors arising in a grinding machine or paper machine from e.g. variations in roller stiffness.

In the invention, it has been discovered that the effect of the deflection of a roller can be compensated by using a suitable control system. The grinding stone can be made to follow the target circumference of the roller in addition to a desired length profile, so that only the non-circularity and other surface deformations of the roller are ground off. By taking the form of the deflection and its straightening during grinding into account, the roundness of the roller can be restored in the shortest possible time.

DETAILED DESCRIPTION OF THE PREFERRED EMBODIMENT

In the grinding method of the invention, when elongated objects of circular cross-section are ground by a single-disc cylindrical grinding process, the object being ground is rotated about its axis. In addition, the grinding stone is rotated and its position on the surface of the object being ground is adjusted so that the grinding point of the grinding stone is held substantially at a target distance from the actual center axis of the object being ground, regardless of the deflection of the object. According to the invention, the position of the grinding stone relative to the surface of the object being ground is adjusted by means of an oscillating positioning controller synchronized with the rotation of the roller and receiving feedback from a measured quantity that bears a linear correlation to the change of position of the surface being ground. The position of the grinding stone is oscillated in a direction perpendicular to the longitudinal axis in synchronization with the rotation of the object being ground.

The method employs an analyzer which computes using a mathematical method from an instantaneous measured quantity, such as distance, and from the roller position a mean vector value (amplitude and phase angle) of the roller surface, i.e. distance, at the rotational frequency of the roller. This vector value represents the eccentricity of the roller. The eccentricity vector is then integrated by the controller and used to control the oscillator. The mathematical method uses a mean vector value of the measured quantity, for example the input power, weighted with the components of the rotational vector of the object being ground.

The measured quantity may be the distance of the surface as measured by electrical or optical means. This quantity may also be the input power or current of the grinding disc or the pressure applied by the grinding disc on the surface being ground. The essential point is that the measure quantity bears a linear correlation to the position change. For example, when the measured quantity is the input power to the grinding stone, the grinding stone is rotated against the surface of the object to be ground while the rotational speed of the grinding stone is held substantially constant. In addition, the voltage is constant and only the current changes when the load in the grinding stone changes. The input power may be measured by measuring an input power of an electric motor rotating the grinding stone. In addition or alternatively, an input current to the electric motor may be measured. So by measuring the input current or the input power information is obtained about the grinding and about the surface eccentricity of the object.

The output of the oscillating positioning controller is preferably summed with other grinding stone positioning signals, i.e. e.g. with a form curve, a structural defect correction and the grinding current value, so that the compensation will work in cooperation with other grinding methods.

The adjustment is preferably performed using a mathematical function forming a model of lengthways deflection of the axis of the object, said model being used to approximate the form of an acceptable physical deflection. The deflection model is preferably adaptive and it follows the straightening of the object occurring during grinding. An acceptable form of the eccentricity can be approximated e.g. by a sine function, such that the oscillating position controller adjusts the object to be ground along a sinusoidal path. Since the object to be grounded is straightened while it is being ground, the grinding stone is oscillated over an entire length of the object to be ground to obtain a substantially circular object having a substantially constant cross-section.

When the grinding method of the invention is used, grinding can be started immediately after the roller has been taken out of storage, without having to wait until the roller has been straightened. Thus, the time required for the grinding can be significantly reduced. In addition, rollers with a better overall profile are achieved than at present.

The method of the invention can generally be used in cylindrical grinding to correct the eccentricity resulting from faulty mounting of a workpiece behaving homogeneously in the direction of rotation. Mounting especially large and heavy objects in a centric manner is a laborious and time-consuming task. This method reduces the time required for mounting and improves the quality of the grinding result.

Applying the grinding method of the invention also involves indirect measurement of the eccentricity, surface contour and lengthways profile of the roller. In other words, a three-dimensional form profile measurement of the roller surface is produced as a by-product of the grinding. This information can be utilized in roller maintenance in estimating the condition of the roller and the final result of the grinding. This system is not a measuring device and its absolute accuracy can not be indicated in the manner required in the case of a measuring device. However, when used together with a known reference measuring device, this system may yield a measuring accuracy as required in maintenance grinding without consuming any time at all for the measurement.

What is claimed:

1. A method of grinding an elongate object with a rotating grinding stone, comprising the steps:

rotating the elongate object about a longitudinal axis;

rotating the grinding stone against a surface of the elongate object at a substantially constant speed and measuring an input power to the grinding stone;

computing a vector value of the surface eccentricity of the elongate object, from the input power to the grinding stone and from a position of the elongate object by using a mathematical method; and adjusting a position of the grinding stone relative to the surface of the elongate object using an oscillating positioning controller based on the computed vector value, so that the position of the grinding stone is oscillated in a direction perpendicular to the longitudinal axis in synchronization with the rotation of the elongate object.

2. The method according to claim 1 wherein computing in the mathematical method uses a mean vector value of the input power weighted with the components of the rotational vector of the elongate object.

3. The method according to claim 1 wherein in the adjusting step, the oscillating position controller adjusts the grinding stone along a sinusoidal path.

4. The method according to claim 1 wherein in the adjusting step, the grinding stone is oscillated over an entire length of the elongate object to obtain a substantially circular object having a substantially constant cross-section.

5. The method according to claim 1 wherein the input power is measured by measuring an input power of an electric motor rotating said grinding stone.

6. The method according to claim 5 wherein an input current is measured.

* * * * *